United States Patent [19]

Fukuma

[11] Patent Number: 4,877,930

[45] Date of Patent: Oct. 31, 1989

[54] SEALED PUSH-BUTTON SWITCH AND METHOD OF ASSEMBLY

[75] Inventor: Yasumichi Fukuma, Hirata, Japan

[73] Assignee: Omron Tateisi Electronics Co., Kyoto, Japan

[21] Appl. No.: 225,129

[22] Filed: Jul. 28, 1988

[30] Foreign Application Priority Data

Aug. 14, 1987 [JP] Japan ..... 62-124670[U]

[51] Int. Cl.[4] ..... H01H 35/02

[52] U.S. Cl. ..... 200/302.2; 200/293; 200/467; 29/622; 425/812; 264/328.1

[58] Field of Search ..... 200/302.2, 302.1, 293, 200/457, 459, 461, 453, 467; 29/622; 264/328.1; 425/812

[56] References Cited

U.S. PATENT DOCUMENTS

| | | | |
|---|---|---|---|
| 3,382,332 | 5/1968 | Cherry et al. | 200/467 |
| 3,822,857 | 7/1974 | Tanie | 425/812 X |
| 3,940,585 | 2/1976 | Schaad | 200/302.2 X |
| 4,482,513 | 11/1984 | Avletti | 425/812 X |
| 4,507,528 | 3/1985 | Vogel et al. | 200/302.2 |
| 4,650,625 | 3/1987 | Pentlow | 264/328.1 X |
| 4,675,778 | 6/1987 | Lewandowski et al. | 200/467 |

FOREIGN PATENT DOCUMENTS

| | | | |
|---|---|---|---|
| 2856686 | 7/1979 | Fed. Rep. of Germany | 200/302.2 |
| 1252112 | 11/1986 | Japan | 425/812 |

*Primary Examiner*—Ernest G. Cusick

*Attorney, Agent, or Firm*—Wegner & Bretschneider

[57] ABSTRACT

A sealed push-button switch which includes a switching mechanism including a terminal, a case including a space for housing the switching mechanism, and a base which is fixed to the case. A frame for housing the terminal is fixed to the base, and a melted resin material is injected into the frame and set to fix the terminal. When the melted resin is injected into the frame, the air in the case is heated and made to expand by the resin. However, the expanded air leaks out through an air passage which is formed through the case of the base. Air bubbles are accordingly prevented from developing in the resin.

10 Claims, 3 Drawing Sheets

SEALED PUSH-BUTTON SWITCH AND METHOD OF ASSEMBLY

BACKGROUND OF THE INVENTION

1. Field of the Invention

This invention relates to a sealed push-button switch, and more particularly, to a sealed push-button switch which is employed to detect a locked door of, for example, a vehicle.

2. Discussion of the Related Art

A well known sealed push-button switch includes a case in which movable and stationary contacts are housed. The case has a cover, and a base in which terminals, to which leads are soldered, are embedded. A frame is fixed to the base at the lower portion of the base. A resin material is injected into the frame and set to fix the leads soldered to the terminals.

In the switch having the foregoing structure, the air in the case is heated by a melted resin material. The heated air expands, leaks out through gaps between the terminals and the base, and further through the melted resin material and produces a rugged outer surface on the set resin. In addition, air bubbles suspended in the resin can coalesce into a passage through which a liquid such as water can pass through the resin to short-circuit the terminals.

SUMMARY OF THE INVENTION

It is, therefore, an object of this invention to provide a sealed push-button switch which has good waterproof qualities.

According to this innvention, there is provided a sealed push-button switch which includes (1) a switching mechanism including a terminal, (2) a case including a space for housing the switch mechanism, (3) a frame for housing the terminal, (4) a resin material injected into the frame and set for fixing the terminal, and (5) an air passage formed through the case for communicating with the space within the case and for letting the air in the space leak out therethrough.

BRIEF DESCRIPTION OF THE DRAWINGS

The above and other objects, advantages and features of this invention will be more fully understood in conjunction with the following figures, in which like numerals designate like or corresponding components and of which.

DETAILED DESCRIPTION OF THE INVENTION

Figure 1:
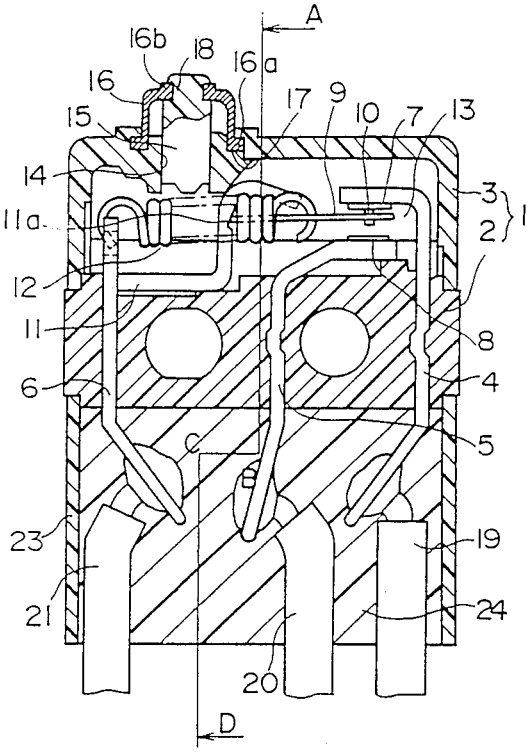
FIG. 1(A) is a front sectional view of a first preferred embodiment of this invention.
FIG. 1(B) is a side sectional view taken along a line A-B-C-D of FIG. 1(A)
Figure 1:
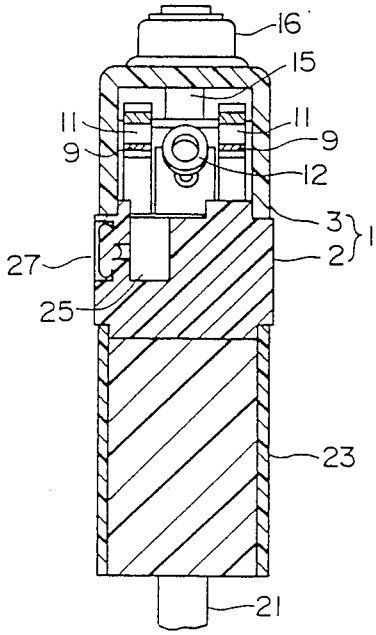

FIGS. 1(A) and 1(B) show a sealed push-button switch according to a first preferred embodiment of this invention.

Case 1 includes a base 2 made of a synthetic resin material and a cover 3 which is made of a synthetic resin material and fixed to base 2 at the upper portion of base 2. Three terminals 4, 5 and 6 are embedded in base 2, and two terminals 4 and 5 extend inside case 1 to vertically oppose each other. A normally closed stationary contact 7 is fixed on terminal 4, and a normally open stationary contact 8 opposite to contact 7 is fixed on terminal 5. A movable contact 10 is fixed on the tip portion of a movable member 9. The base portion of movable member 9 engages an engagement recess 11*a* of an engaging member 11. Movable member 9 is pivotally supported around recess 11*a* and is electrically connected to terminal 6 via engaging member 11. A coil spring 12, which is made of metal, for restoring movable member 9 is suspended from the one end of terminal 6 and movable member 9. A switch mechanism 13 comprises stationary contacts 7 and 8, movable member 9, movable contact 10, and coil spring 12.

A push-button 15 made of a synthetic resin material is slidably inserted into a through-hole 14 formed in the top of cover 3. The lower end of button 15 abuts coil spring 12. An annular groove 17 is formed around button 15 on the top of cover 3, and an annular groove 18 is formed on the upper portion of button 15. One opening end 16*a* of a generally cylindrical seal member 16 is fixed to annular groove 17 using a bonding agent (not shown), and the other opening end 16*b* thereof is fixed to annular groove 18. Seal member 16 thus surrounds the periphery of button 15. Leads 19, 20 and 21 are soldered to terminals 4, 5 and 6, respectively.

A frame 23 which is made of a resin material such as polycarbonate for housing terminals 4, 5 and 6, and leads 19, 20 and 21 is fixed to the lower portion of base 2. An epoxy resin 24 is injected and set in frame 23, thereby fixing the ends of terminals 4, 5 and 6, and leads 19, 20 and 21.

Figure 2:
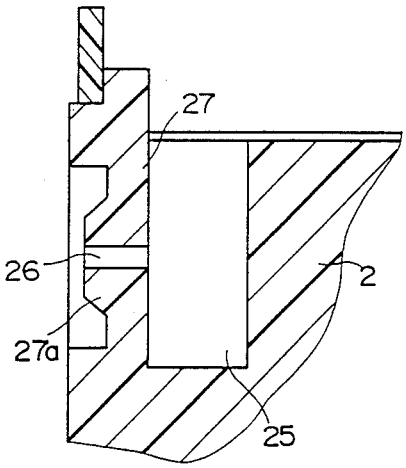
FIG. 2(A) is an enlarged sectional side view illustrating an air passage.
FIG. 2(B) is an enlarged sectional side view illustrating a clogged air passage.
FIG. 2(C) is another enlarged sectional side view illustrating a clogged air passage.
Figure 2:
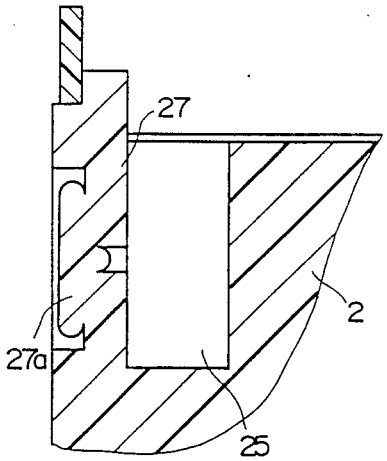
Figure 2:
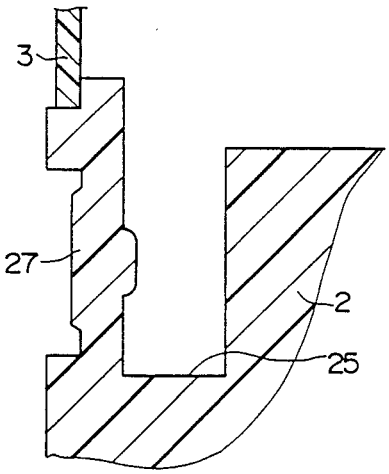

Base 2 includes a wall 27, and a recess 25 which communicates with the space where switch mechanism 13 is housed. As shown in FIG. 2, wall 27 has an annular, "mesa-shaped" protrusion 27*a*, and an air passage 26 is formed through wall 27 and protrusion 27*a*. Air passage 26 communicates with recess 25. Protrusion 27*a* is heated and melted to clog air passage 26 as shown in FIG. 2(B) or FIG.2(C) after the setting of resin material 24 injected into frame 23.

Figure 3:
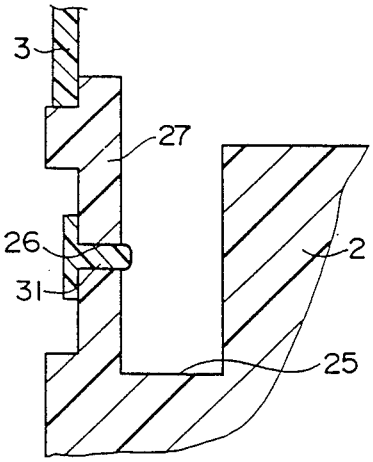
FIG. 3 is an enlarged sectional side view of a second preferred embodiment of this invention.

When melted resin material 24 is injected into frame 23, the air in case 1 is heated and made to expand by resin 24. The expanded air leaks out through recess 25 and air passage 26. Air bubbles or air passages are accordingly prevented from developing in resin material 24. Consequently, a high degree of waterproofing of resin 24 can be achieved. In addition, terminals 4, 5 and 6 can be prevented from being short-circuited to each other. Moreover, the exterior of resin 24 remains smooth because the expanded air does not leak out through resin 24. Another resin material can be used to clog air passage 26 instead of protrusion 27*a*. In addition, as shown in FIG. 3, sealing member 31 made of a synthetic resin material can be used to seal the switch.

Figure 4:
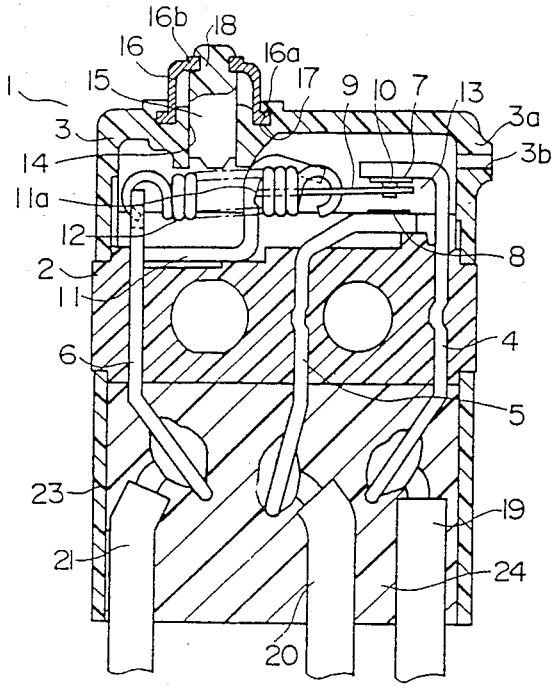
FIG. 4(A) is a sectional side view of a third preferred embodiment of this invention.
FIG. 4(B) is a sectional side view of the third preferred embodiment of this invention after the air passage shown in FIG. 4(A) is clogged.
Figure 4:
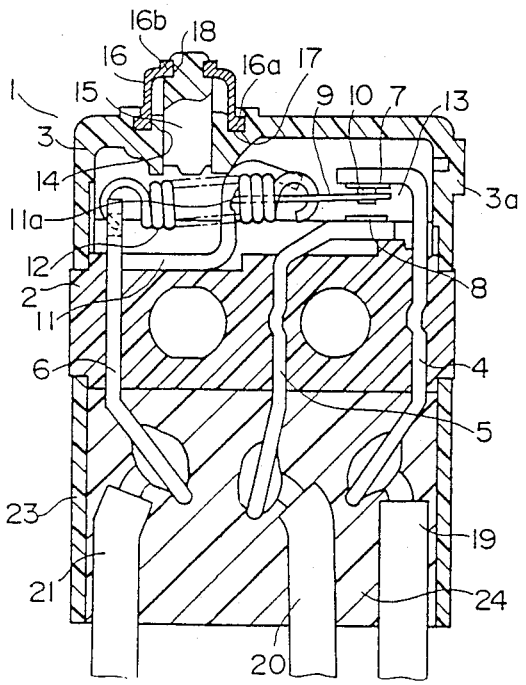

FIGS. 4(A) and 4(B) show a sealed push-button switch according to a third embodiment of this invention. Cover 3 includes an annular, "mesa-shaped" protrusion 3*a*, and an air passage 3*b* which is formed through protrusion 3*a*. After resin material 24 is injected into frame 23 and set, protrusion 3*a* is melted to clog air passage 3*b* as shown in FIG. 4(B).

The operation of the switch is described below. When button 15 is depressed, movable member 9 is downwardly biased by coil spring 12. Movable contact 10 accordingly breaks contact with normally closed stationary contact 7. On passing over a predetermined point, movable member 9 snaps with the biasing force of coil spring 12 and causes movable contact 10 to contact with normally open stationary contact 8. When button 15 is released, movable member 9 returns to its original position through the restoring force of coil spring 12.

This invention can be applied to other sealed switches such as a sealed limit switch.

The above description and the accompanying drawings are merely illustrative of the application of the principles of the present invention and are not limiting. Numerous other arrangements which employ the principles of the invention and which fall within its spirit and scope may be readily devised by those skilled in the art. Accordingly, the invention is not limited by the foregoing description, but only limited by the scope of the appended claims.

I claim:

1. A sealed push-button switch, comprising:

a case, comprising a base and a cover attached to said base so as to form a space between the cover and the base;

a switching mechanism located in said space, said switching mechanism having a terminal which extends through the base so that one end of said terminal is located outside the case;

a frame attached to the case for housing said one end of said terminal;

a resin material injected into said frame and set for fixing said one end of said terminal; and an air passage formed through said case so as to communicate with said space, for allowing air in the space to leak therethrough; and sealing means for sealing said air passage after said resin material is injected into said frame.

2. The sealed push-button switch as in claim 1, wherein said base includes a recess communicating with said space and a wall providing said recess, wherein said air passage is formed through said wall.

3. The sealed push-button switch as in claim 2, wherein said sealing means includes an annular, mesa-shaped protrusion formed in said wall which is melted to clog the passage.

4. The sealed push-button switch as in claim 1, wherein said sealing means comprises a sealing member which is tightly inserted into said air passage to seal the push-button switch.

5. The sealed push-button switch as in claim 1, wherein said air passage is formed through said cover.

6. A method for assembling a push-button switch, said switch comprising a switching mechanism located in a space formed between a base and a cover of a case, said switching mechanism having a terminal which extends through the base so that one end of said terminal is located outside the case, said method comprising:

forming an air passage in said case which commuicates with said space so as to allow air in the space to leak therethrough;

attaching a frame to the case for housing said one end of said terminal;

injecting a resin material into said frame, wherein said resin material sets so as to fix said one end of said terminal; and sealing said air passage after said resin material is injected into said frame.

7. The method as claimed in claim 6, further comprising forming a recess in said base which commuicates with said space, wherein said air passage is formed through a wall of said recess.

8. The method as claimed in claim 7, further comprising forming an annular, mesa-shaped protrusion on said wall, wherein said air passage is sealed by melting said mesa-shaped protrusion.

9. The method as claimed in claim 6, wherein said air passage is sealed by inserting a sealing member into said air passage.

10. The method as claimed in claim 6, wherein said air passage is formed through said cover.

* * * * *